United States Patent [19]

DeSantis et al.

[11] Patent Number: 4,829,261

[45] Date of Patent: May 9, 1989

[54] CIRCUITLESS ELECTRON BEAM AMPLIFIER (CEBA)

[75] Inventors: Charles M. DeSantis, Neptune; Louis J. Jasper, Jr., Ocean, both of N.J.

[73] Assignee: The United States of America as represented by the Secretary of the Army, Washington, D.C.

[21] Appl. No.: 167,743

[22] Filed: Dec. 8, 1987

[51] Int. Cl.[4] ..... H01J 25/34; H05B 6/64

[52] U.S. Cl. ..... 330/4; 315/3.6; 335/304

[58] Field of Search ..... 330/4, 43; 315/3.6, 315/5.16; 335/304; 331/104

[56] References Cited

U.S. PATENT DOCUMENTS

| | | | |
|---|---|---|---|
| 4,347,419 | 8/1982 | Jasper | 315/3.6 |
| 4,389,593 | 6/1983 | DeSantis | 315.4/315.3 |
| 4,564,787 | 1/1986 | Kosmahl | 315/3.6 |
| 4,612,476 | 9/1986 | Jasper et al. | 315/3.6 |
| 4,621,218 | 11/1986 | Jasper et al. | 315/3.6 |
| 4,692,732 | 9/1987 | Lenpold et al. | 335/304 |
| 4,701,737 | 10/1987 | Lenpold | 335/304 |

OTHER PUBLICATIONS

Walter Beam, "On the Possibility of an Amplification in Space-Charge-Potential-Depressed Electron Streams," Proc. IRE, pp. 454-462, Apr. 1955.

R. E. Hayes, "A Synchronous Wave Amplifier," IEEE Transactions on Electron Devices, Mar. 1964, pp. 98-101.

T. Wesselberg, "A Thick Beam Analysis of Transverse Wave Propagation on Electron Beams". Proc. 4th International Congress on Microwave Tubes, pp. 657-663, Sep. 1962.

Bayram Vural, "Double-Stream Cyclotron Wave Amplifier", IEEE Transactions on Electron Devices, vol. Ed-15, No. 1, Jan. 1968, pp. 2-6.

M. R. Currie, et al., "The Cascade Backward-Wave Amplifier: A High Gain Voltage-Tuned Filter for Microwaves," Proc. IRE, pp. 1617-1631, Nov. 1955.

*Primary Examiner*—Nelson Moskowitz

*Attorney, Agent, or Firm*—Sheldon Kanars; John K. Mullarney

[57] ABSTRACT

A traveling wave type amplifier. The device features a pair of short helical input and output couplers through which an electron beam is projected. Application of an RF signal to the couplers serves to modulate the electron beam. A drift tube to be positioned between the couplers is dimensioned to attenuate the RF signal while permitting the modulated electron beam to pass through. An amplified output signal is extracted from the output helix. Gain of the tube is enhanced by a linearly decreasing magnetic focussing field.

6 Claims, 1 Drawing Sheet

CIRCUITLESS ELECTRON BEAM AMPLIFIER (CEBA)

The invention described herein may be manufacrtured, used and licensed by or for the Government without payment to me of any royalty thereon.

BACKGROUND OF THE INVENTION

1. Field of the Invention

This invention relates generally to microwave power tubes and more particularly to linear-beam traveling wave tubes.

2. Description of the Prior Art

The traveling wave tube amplifier is widely used as a source of RF and microwave power for a variety of radar and communications applications. The conventional traveling wave tube, particularly in its low and medium power versions, in unmatched in bandwidth capability by either the klystron or the cross-field tube. A basic traveling wave tube amplifier consists of an electron gun which projects a focussed electron beam through a slow-wave structure (typically a helix or a coupled-cavity structure) toward a collector. The electrons are maintained in a narrow beam through the center of the slow-wave structure by a magnetic field. A c-w or pulse signal, coupled onto the slow-wave structure in the vicinity of the electron gun, generates a wave that travels in close proximity to the slow-wave structure at a velocity which is slightly less than the electron velocity. The electron velocity is, of course, determined by the potential difference between the electron gun cathode and the collector. The potential difference is adjusted to insure that the electrons, on the average, travel slightly faster than the RF wave. The electric field of the RF wave on the slow-wave structure interacts with the electric field created by the electron beam causing an increase in the amplitude of the RF wave on the slow-wave structure, thus producing the desired amplification.

Many traveling wave tubes utilize a helix wound with molybdenum wire as the slow-wave structure. The amount by which the input RF wave is slowed depends upon the pitch and radius of the helix. Interaction between the RF wave and the electron beam produces a bunching of electrons in the beam. This bunching processes, in turn, contributes to amplification of the RF wave.

The amplified RF wave is extracted from the helix at the downstream end of the tube. The electrons continue toward the collector where they are collected. Both theory and experiment indicate that some of the RF wave is reflected from the output end of the tube. The reflected wave may travel back through the helix to the tube input and cause unwanted oscillations. Consequently, it is customary to insert lossy materials such as carbon film at locations along the helix between the electron gun and collector to attenuate the reflected traveling wave. Unfortunately, this procedure attenuates the forward wave as well as the reflected wave. Another technique for reducing the reflected wave is to sever the helix. The sever prevents reflections from the load and the output terminal from reaching the input terminal. Although the forward growing wave on the input section of the helix is lost at the sever, current and velocity modulation remain impressed upon the electron beam which carries the signal across the sever region for further amplification in the output section.

The electrons which travel through the helix are collected in a collector at the downstream end of the tube. When the collector is at the same potential as the body of the tube, the electrons strike the collector at a relatively high velocity. Electron energy is then converted to heat at the collector surface. By reducing (depressing) the voltage on the collector below the tube body potential, the velocities of the electrons striking the collector and the heat generated in the collector are reduced. As a result, a depressed collector recovers some of the power in the spent electron beam.

A variety of articles are pertinent to an understanding of the present invention. One example is: Walter Beam, "On the Possibility of an Amplification in Space Charge Potential Depressed Electron Streams," Proc. IRE, pp. 454–462, Apr. 1955. The Beam article derives analytical expressions to predict the behavior of electron streams subject to space-charge effects. Another pertinent publication is: R. Hayes, "A Synchronous Wave Amplifier," IEEE Transactions on Electron Devices, March 1964, pp. 98–101. The Hayes article presents the derivation on analytical expressions for the gain of a linear tube device similar to a klystron. A further pertinent article is: T. Wesselberg, "A Thick Beam Analysis of Transverse Wave Propagation on Electron Beams," Proc. 4th International Congress on Microwave Tubes, pp. 657–663, Sept. 1962. The Wesselberg article presents a variety of dispersion and energy relations of transverse electromagnetic waves on electron beams. Another publication of interest is: B. Vural, "Double Stream Cyclotron Wave Amplifier," IEEE Transactions on electron Devices, Vol. ED-15, No. 1, January 1968, pp. 2–6. The Vural article discusses the operation of an electron beam amplifier utilizing a non-uniform magnetic field. Finally, another publication of interest is: M.R. Currie, et al., "The Cascade Backward Wave Amplifier: A High Gain Voltage Tuned Filter for Microwaves," Proc. IRE, pp. 1617–1631, Nov. 1955. The Currie et al article discusses an electron beam tube which utilizes two helices—an input helix and an output helix. The input signal is introduced at the collector end of the input helix and the signal is amplified as it travels toward the gun end of the tube. The amplified signal is dissipated in a matched helix termination at the gun end of the tube. However, the modulated electron beam passes through a drift tube and then into a second helix or other slow-wave structure also interacting with a backward wave. The output signal is then taken from the gun end of the output helix, with the collector end of the output helix matched. The article goes on to explain that such a wave has a group velocity and phase velocity in opposite directions.

A patent pertinent to an understanding of the present invention is U.S. Pat. No. 4,389,593, entitled "Active Dielectric Waveguide Amplifier or Oscillator Using a High Density Charged Particle Beam," issued to the present inventors. The patent discloses a circuitless particle beam device that eliminates the requirement for an internal slow wave structure. A circularly polarized RF wave propagates on a high density particle beam within an oversized waveguide and interacts with the beam to produce amplification.

In general, traveling wave tube dimensions are scaled by desired output wavelengths. At frequencies (wavelengths) in the millimeter wave range dimensions become extremely small and miniaturized slow wave structures and supports are used. As slow wave structures become smaller, heat dissipation problems become more severe. At millimeter wave frequencies, the slow wave circuit structure contributes a substantial amount to the cost and complexity of the tube.

Those concerned with the development of the power tubes art have consistantly sought inexpensive and simply constructed designs which are nevertheless capable of high power output.

BRIEF SUMMARY OF THE INVENTION

It is an object of the present invention to provide a simple, relatively inexpensive, compact microwave power tube.

It is another object of the present invention to provide an effective microwave power tube which is amenable to mass-production techniques.

A further object of the present invention is to provide a microwave power tube capable of high gain operation.

The present inventive device is designed to operate in the 4–8 GHz range in a pulsed low duty mode.

The present invention features an electron gun, a collector with water cooling capability, a pair of helical slow wave structures, and a magnetic focusing structure. Unlike conventional traveling wave tubes, which utilize a long (50–200 wavelengths) helical circuit as a slow wave structure, the present device features short (1–10 wavelengths) input and output helical circuits.

Magnetic focusing of the beam may be accomplished by either a coil or a permanent magnet focusing structure. In the preferred embodiment of the present invention, a smooth, linearly-decreasing magnetic field from electron gun to collector is used. Such a linearly-decreasing magnetic field provides strong RF interaction. A lightweight permanent magnet focusing structure capable of providing a linearly-decreasing magnetic field is disclosed in two copending U.S. patent application Ser. No. 868,862, now U.S. Pat. No. 4,692,732, entitled "Parametric Linear Variation of a Leakage-Free Permanent Magnet Source" invented by H. Leupold et al. and Ser. No. 868,863, now U.S. Pat. No. 4,701,737, entitled "A Leakage-Free;, Linearly Varying Axial Permanent Magnet Field Source," also invented by Leupold now U.S. Pat. Nos. 4,692,732 and 4,701,737, respectively.

The region between the input and the output helical couplers is called the drift region. An undersized cylindrical waveguide is positioned in the drift region between the two helical couplers. The diameter of the cylindrical waveguide is chosen so that the waveguide is below cutoff at the frequency of device operation. Consequently, electromagnetic waves cannot propagate in either direction through the drift region. Energy is transferred through the drift region only by modulation of the electron beam. Experiments have shown that the energy is only transferred in the direction of the electron flow. It is non-reciprocal. Thus, the waveguide serves both as vacuum housing and as attenuator. The drift region waveguide is coupled on both ends to vacuum housings which are above cutoff for the frequency of operation. The electron gun is located in one of the two larger vacuum housings and the collector is located in the other large vacuum housing.

The input and output helical couplers are supported inside the large vacuum housings by one ceramic-glass disk per coupler with one end of each coupler being attached to an RF feed-through window and the other end of the coupler unattached. In some embodiments of the present invention, the unattached ends of the input and output couplers face the electron gun and collector respectively—such helical orientations are termed "backward" helices. In other embodiments, the unattached ends of both couplers face the central drift region.

For convenience in discussing operation of the device, the direction from electron gun to collector will be termed the "forward" direction and waves with a group velocity and phase velocity traveling in the forward direction will be termed "forward waves," while waves with group velocity traveling in the opposite direction and phase velocity traveling in the forward direction will be termed "backward" waves.

In operation, the electron gun generates a beam of electrons which proceeds in the forward direction toward the collector. An input RF signal is applied to the input helix. The input signal follows the backwardoriented helix while modulating the electron beam and inparting its energy to the beam as it travels through the helix. The modulated beam travels through the drift region which, as mentioned before, is enclosed by a waveguide too small to propagate electromagnetic radiation at the frequency of interest. the modulated beam then interacts and gives up its RF energy to the output helix, the RF energy being an amplified backward travelling wave which by means of an RF window is extracted from the tube.

BRIEF DESCRIPTION OF THE DRAWINGS

Further objects and advantages of the present invention will become apparent to those familiar with the art upon examination of the following detailed description and accompanying drawings.

DETAILED DESCRIPTION OF THE PREFERRED EMBODIMENTS

Figure 1:
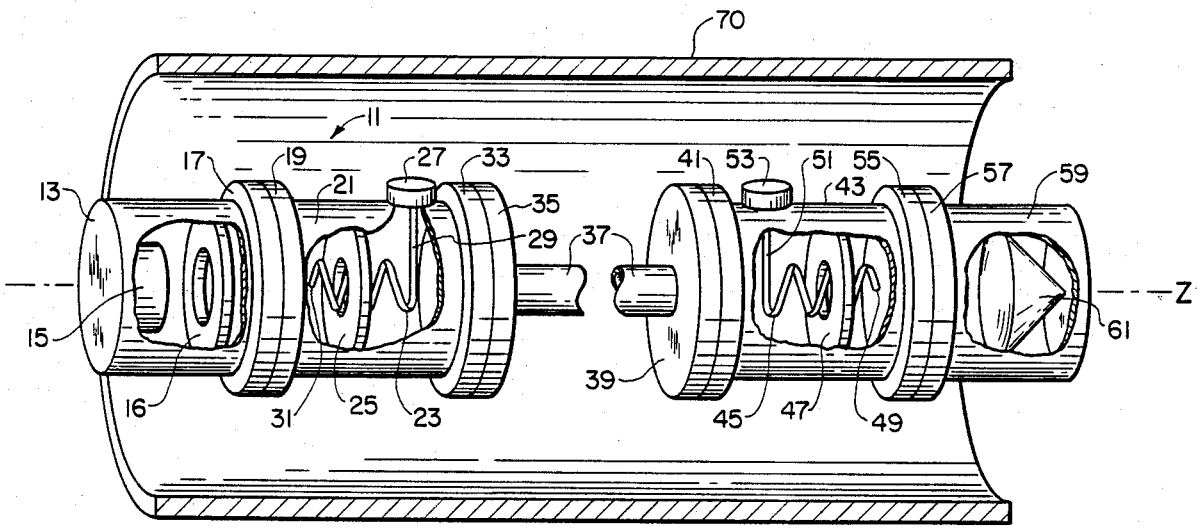
FIG. 1 is a schematic view of one preferred embodiment on the present invention.

Referring to the drawings, and more particularly to FIG. 1 wherein like numerals referred to like components throughout, the reference numeral 11 designates generally the inventive device. A housing 13 encloses an electron gun 15 and associated anode 16. Characteristics of the electron gun 15 and anode 16 are summarized in Table 1 below:

TABLE I

| (Characteristics of the Electron gun assembly) |
|---|
| (C) |
| Current - 1.7 A |
| Voltage - 11 kV |
| Perveance - $1.5 \times 10^{-6}$ A/V$^{3/2}$ |
| Beam Radius (min) - 0.062 cm |
| Cathode Loading - 5 A/cm$^2$ |
| Cathode Half Angle - 34° |
| Cathode Type - tungsten matrix |
| Grid Type - intercepting |
| Grid Bias - approximately -100 V |
| Heater Current - 1.7 A |
| Heater Voltage - 6.3 V |
| Anode - integral pole piece |

A pair of mating flanges, 17 and 19, serves to connect housing 13 with housing 21. These flanges can be replaced by a more permanent means such as welding both housings together. In a preferred embodiment, the diameter of housing 21 is 1.5 inches. The diameter of housing 13 is not critical—the housing merely encloses the electron gun 15. The housing should be sufficiently large in diameter to avoid RF currents being impressed on the housing surface. Input helix 23 is supported within housing 21 by ceramic disk 25. Table 2 below summarizes the characteristics of the helical coupler 23.

TABLE 2

| (Characteristics of the Helical Couplers) |
|---|
| (C) |
| Number of Turns (N) - 8 |
| Wire Size Diameter ($d_w$) - 0.05 inches (#16 wire) |
| Wire Material - molybdenum |
| Coupler Circumference (C) - 2.04 cm |
| Distance Between Turns (S) - 0.681 cm |
| Axial Length (NS) - 5.45 cm |
| Pitch Angle - 18.5° |
| Diameter of Coupler (d) - 0.648 cm |

The input end 29 of coupler 23 is attached to and supported by a standard RF window 27. The other end 31 of coupler 23 is unattached, and faces electron gun 15.

Housing 21 is terminated by flange 33. Flange 33 mates with flange 35 which is integral with housing 37. Likewise these flanges can be replaced by welding both housings together. Housing 37 contains the drift region of the device 11. The diameter for housing 37, in a preferred embodiment is 0.75 inches. The diameter of housing 37 is chosen to make the housing behave like a waveguide below the desired cut-off frequency of device operation. Housing 37 is integral with flanges 35 and 39. Flange 39 mates with flange 41. Flange 41 is integral with housing 43.

Housing 43 is similar to housing 21. In a preferred embodiment, housing 43 has a diameter of 1.5 inches, the same as the diameter of housing 21. Housing 43 also contains a helical coupler 45, similar to the helical couple 23, contained in housing 21. Coupler 45 is supported by a ceramic disk 47. The input end of coupler 45 is supported and terminated in an RF window 53. The other end 49 of coupler 45 is unconnected and faces collector 61. Flange 55 is integral with housing 43. Flange 55 mates with flange 57, the latter being integral with housing 59. Housing 59 contains collector 61, which may be water cooled.

Housings 13, 21, 37, 43 and 59 may be fabricated as a single integral piece, if desired, obviating the need for flanges 17, 19, 33, 35, 39, 41, 55 and 57. The above-mentioned flanges merely facilitate assembly and disassembly of the device 11. However, it is important, if a single integral housing is to be fabricated, that the drift region in housing 37 be a structure whose diameter is below waveguide cut-off at the device operating frequency.

No matter how the device housing (s) are fabricated, the entire device 11 must be capable of supporting a vacuum of at least $10^{-8}$ Torr. Details of the vacuum apparatus, well known to those skilled in the art, are omitted for simplicity.

The collector 61 is a standard type, well known to those skilled in the art. In a preferred embodiment, the collector 61 may be water-cooled. Similarly, RF windows 27 and 53 are standard components, well known to those skilled in the art, for effecting smooth impedance transitions between the helical couplers and the exterior of the tube.

As mentioned before, the unconnected end 31 of coupler 23 is located proximate to the electron gun 15, whereas the input end 29 of coupler 23 is located distal to electron gun 15. Similarly, unconnected end 49 of coupler 45 is located proximate to collector 61, while the output end 51 of 45 is positioned distal to collector 61. The above-described orientation of the helices 23 and 45 facilitates interaction with backward-traveling electromagnetic waves.

It has been experimentally and theoretically determined that the gain is dependent upon the externally applied magnetic focusing field. Therefore, a coil, or series of permanent magnets 70 is positioned to surround the device 11. When the magnetic focusing field is tapered to decrease in the axial direction from electron gun anode 15 to collector 61, the gain is enhanced. In a preferred embodiment, the magnetic field varies according to equation 1 below:

$$B_{oZ} = B_o\left[1 - \left(\frac{B_{oL}}{B_o}\right)\frac{Z}{L}\right] \quad (1)$$

where $B_o$ is the initial field amplitude along axis Z of the gun anode 16 (Z=o) and $B_{oL}$ is the field amplitude on axis at a distance L from the anode (Z=L).

Typically, the magnetic field decreases linearly from approximately 1200 to 600 Gauss over the region between RF input 27 and RF output 53.

A permanent magnet structure suitable for producing a linearly decreasing magnetic field profile is disclosed in two aforementioned copending applications.

The potential of the collector 61 may be depressed, utilizing a DC voltage source not illustrated in FIG. 1, to greater than 80% of the electron gun cathode potential. As discussed previously, such depressed collector operation improves tube efficiency.

Experimental results have shown that a definite polarity (direction for the magnetic focusing field) is required for a strong interaction and hence gain. This implies that the electron beam is rotating around an axis in a right or left sense and that the electro-magnetic fields are also polarized in the same sense. It was found experimentally that maximum power output occurred when electron rotating direction matched helix winding sense (pitch).

In operation, an RF input signal is coupled to window 27, and thence to input helix 23. The RF signal on the helix 23 interacts with and modulates the electron beam emitted from the electron gun 15. The modulated beam passes through housing 37. Of course, the RF signal cannot propagate as a current on housing section 37 because the section 37 acts like a waveguide with dimensions below the cut-off frequency of the RF signal. The modulated electron beam carrying an amplified RF backward wave (which has been amplified by an interaction between a slow space charge wave on the beam and a synchronous wave on the beam) enters housing 43 and interacts with helix 45. The linearly decreasing magnetic field plays a key role in synchronizing the phase velocities of the slow space charge wave and the synchronous wave. Amplified RF energy is imparted onto helix 45. The energy propagates along helix 45 and thence to output RF window 53.

Figure 2:
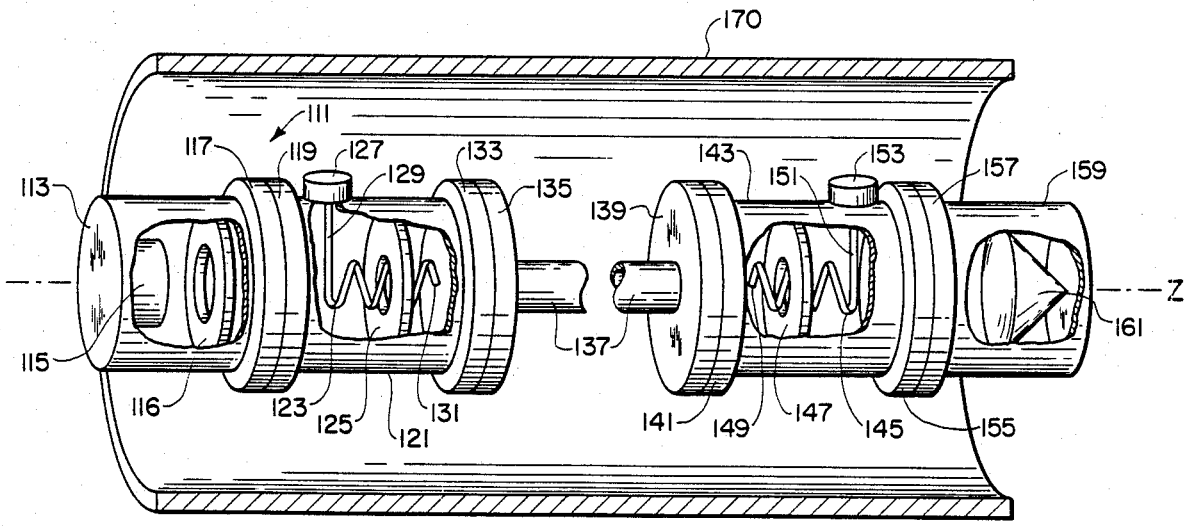
FIG. 2 is a schematic view of an alternative preferred embodiment of the present invention.

FIG. 2 is illustrative of an alternative embodiment of the present device. The difference between the device of FIG. 2 and the device of FIG. 1 is that helices 123 and 151 of FIG. 2 are oriented so that their unattached ends 131 and 149 respectively face the drift region 137 of the device 111. (As already mentioned in connection with FIG. 1, helices 23 and 51 are oriented so that their unattached ends 31 and 49 face electron gun 15 and collector 61 respectively).

In all other respects the device of FIG. 2 resembles the device of FIG. 1. Electron gun 115 and anode 116, together with collector 161 in FIG. 2 are similar in construction and operation to their counterparts in FIG. 1.

Housing 137 has a diameter which is below the waveguide cutoff diameter at the device operating frequency.

RF windows 127 and 153 are standard components similar to their counterparts in FIG. 1. The magnetic field created by magnet or coil 170 is the same as the magnetic field created by coil or magnet 70.

The device of FIG. 2 facilitates a forward wave interaction.

The frequency of operation for the forward wave interaction need not be adjusted by variation of tube operating voltage while for the backward wave interaction, the frequency is tunable by a variation of tube operating voltage. The forward wave interaction gives an instantaneous frequency band-width and the backward wave interaction does not.

The illustrative embodiments herein are merely a few of those possible variations which will occur to those skilled in the art while using the inventive principles taught herein. Accordingly, numerous variations of invention are possible while staying within the spirit and scope of the invention as defined in the following claims and their legal equivalents.

What is claimed is:

1. An electron beam amplifier comprising an evacuated, three section cylindrical housing:

an electron gun located at a first end of the first of said housing sections;

a first helix, with a maximum of 10 turns located at the second end of said first housing section, said helix having an axis generally coaxially aligned with said first housing section;

a first RF window in the wall of said first housing near said second end, said window being connected to said first helix whereby an input signal incident upon said first RF window is transmitted to said first helix;

said first and third housing sections having equal diameters, and said second housing section having a diameter less than the diameters of said first and third sections and being positioned between said first and third sections;

a second helix with a maximum of 10 turns, having an axis coaxial with said third housing section and located at the end of said third section proximal to said second section;

a second RF window in the wall of said third housing section proximal to said second section, said second window being connected to said second helix whereby an amplified output signal may be coupled from said helix; and an electron collector located at the end of said third section distal from said second section;

means for producing a linearly decreasing magnetic field from said electron gun to said collector whereby activation of the electron gun causes an electron beam to flow from first section, through second section into third section and then be captured by said collector, while introduction of an input signal upon said first RF window causes said signal upon interaction with said electron beam and said helices to generate electromagnetic radiation within said housing and to emerge as an amplified signal at said second RF window, said second housing section comprising a cylindrical waveguide for coupling the electron beam from the electron gun in the first housing section to the electron collector in the third housing section, said cylindrical waveguide having a diameter that is less than the waveguide cut-off frequency diameter for the intended operative frequency so that electromagnetic waves are prevented from propagating therethrough in either direction.

2. The device of claim 1 wherein said magnetic field varies from 1200 gauss to 600 gauss from said gun to said collector.

3. The device of claim 2 wherein each of said first and second helices are supported by a single respective ceramic disc.

4. The device of claim 3 wherein said collector has a voltage which is depressed relative to said electron gun anode voltage.

5. The device of claim 4 wherein said first and second helices have respective free ends, said free ends facing said electron gun and said collector respectively.

6. The device of claim 5 wherein said first and second helices have respective free ends, said free ends both facing said second housing.

* * * * *